US007331496B2

(12) United States Patent
Britz et al.

(10) Patent No.: US 7,331,496 B2
(45) Date of Patent: Feb. 19, 2008

(54) HAMMER DRILL

(75) Inventors: Rory Britz, Kaufering (DE); Rainer Ontl, Landsberg am Lech (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/105,567

(22) Filed: Apr. 15, 2005

(65) Prior Publication Data

US 2005/0224242 A1 Oct. 13, 2005

(30) Foreign Application Priority Data

Apr. 8, 2004 (DE) ..... 10 2004 018 084

(51) Int. Cl.
*E02D 7/02* (2006.01)

(52) U.S. Cl. ..... 227/48; 227/29; 227/217; 74/22 R; 74/22 A

(58) Field of Classification Search ..... 173/176, 173/109, 29, 46, 48, 217, 170; 74/22 R, 74/22 A, 377, 378
See application file for complete search history.

(56) References Cited

U.S. PATENT DOCUMENTS 4,763,733 A * 8/1988 Neumaier ..... 173/48
4,825,961 A * 5/1989 Neumaier et al. ..... 173/109
5,513,546 A * 5/1996 Ikeda et al. ..... 81/57.13
5,842,527 A * 12/1998 Arakawa et al. ..... 173/48
6,035,945 A * 3/2000 Ichijyou et al. ..... 173/48
6,109,364 A * 8/2000 Demuth et al. ..... 173/48
6,176,321 B1 * 1/2001 Arakawa et al. ..... 173/48
6,192,996 B1 * 2/2001 Sakaguchi et al. ..... 173/48
6,460,627 B1 * 10/2002 Below et al. ..... 173/48
6,510,903 B2 * 1/2003 Funfer ..... 173/48
6,520,267 B2 * 2/2003 Funfer et al. ..... 173/48
6,557,648 B2 * 5/2003 Ichijyou et al. ..... 173/48
6,712,156 B2 * 3/2004 Funfer ..... 173/48
6,725,944 B2 * 4/2004 Burger et al. ..... 173/48
6,868,919 B1 * 3/2005 Manschitz et al. ..... 173/47
6,942,435 B2 * 9/2005 Schaible et al. ..... 408/124

* cited by examiner

*Primary Examiner*—Hemant M. Desai
*Assistant Examiner*—Michelle Lopez
(74) *Attorney, Agent, or Firm*—Abelman, Frayne & Schwab

(57) ABSTRACT

A hammer drill (2) includes a clockwise and counterclockwise driven tool spindle (28), a drive pinion (70) operatively connectable with the tool spindle (28) for transmitting a torque thereto, a separate control handle (6) for selecting one of the hammer drill functions including a pure drilling operation, a pure percussion operation, and a rotary-percussion operation), and a switching device (8) which is adjustable in accordance with a position of the control handle (6) and which is shiftable by the control handle (6) in a clockwise rotation position for effecting a pure drilling operation in a clockwise direction and in a counterclockwise rotation position for effecting a pure drilling operation in a counterclockwise direction.

13 Claims, 9 Drawing Sheets

HAMMER DRILL

BACKGROUND OF THE INVENTION

1. Field of the Invention

The present invention relates to a hammer drill including a clockwise and counterclockwise driven tool spindle, a drive pinion operatively connectable with the tool spindle for transmitting a torque thereto, a separate control handle for selecting one of drill functions including a pure drilling operation, a pure percussion operation, and a drilling or rotary and percussion operation, and a switching device adjustable in accordance with the position of the control handle.

2. Description of the Prior Art

Hammer drills of the type described above are very operator-friendly because switching between all three drill functions with the same control handle is possible. Moreover, the control handle can be easily arranged in such a way that switching of the drill functions takes place at an easily accessible and well visible location.

German Publication DE-195 45 260 discloses a hammer drill in which switching between a pure drilling operation, a rotary-percussion operation, and a pure percussion operation is effected with a single rotary switch. The rotary switch is connected with a rotatable body for joint rotation therewith. The rotatable body displaces a shifting bushing arranged on an intermediate shaft and shifting sleeve arranged on the tool spindle. The percussion mechanism of the hammer drill is actuated and deactuated dependent on the position of the shifting bushing. Simultaneously, dependent on the position of the shifting sleeve, the tool spindle rotates or is secured to the housing without a possibility of rotation. Further, the hammer drill has an actuation member which is provided on an on-off switch and which serves for switching between clockwise and counterclockwise rotation of the tool spindle by changing the polarity of the drive motor.

The drawback of the known hammer drill consists in that a separate switch should be provided for effecting the clockwise and counterclockwise operations and which is poorly visible. Further, in such a hammer drill, because of two rotational directions of the motor, the fan likewise should be adapted for operation in opposite directions. This reduces the power of the fan and thereby its cooling effect.

Accordingly, an object of the present invention is to provide a hammer drill in which the drawbacks of the known hammer drill are eliminated and the operating convenience is increased.

SUMMARY OF THE INVENTION

This and other objects of the present invention, which will become apparent hereinafter are achieved by providing a hammer drill in which the switching device is shiftable by the control handle in a clockwise rotation position for effecting a pure drilling operation in a clockwise direction and in a counterclockwise rotation position for effecting a pure drilling operation in a counterclockwise direction.

With such a switching device, the switching between clockwise and counterclockwise operations can be effected with the same control handle that is used for selection of an operational function, which insures a better handling of the hammer drill. Further, the switching between the clockwise and counterclockwise operations is clearly visible and, generally, the operating convenience of the hammer drill is increased.

Advantageously, the switching device includes clockwise gear means and counterclockwise means for alternating forming a clockwise rotational connection and a counterclockwise rotational connection between the tool spindle and the drive pinion in the pure drilling operation. Such gear drive means for switching of a rotational direction can be particularly easy, in comparison with the switching of the rotational direction by changing the polarity of the drive motor, integrated in the switching device for performing an additional switching function. In addition, the switching of the rotational direction with the same function—selecting control handle reduces manufacturing and operational costs, which further increases the operating convenience of the hammer drill. Moreover, with switching of the rotational direction with drive gear means, the motor and the fan, which is driven by the motor, can be operated only in one direction. Thereby, the shape of the fan, in particular, the shape of the fan lamellas can be optimized in order to achieve a better cooling efficiency.

Advantageously, the switching device is brought by the control handle in an additional position in which both the clockwise and counterclockwise drive gear means occupies a position in which both the clockwise rotational connection and the counterclockwise rotational connection between the drive pinion and the tool spindle are broken, and the tool spindle is rotatable relative to a hammer drill housing.

Thus, the control handle provides an adjusting or set-up position of the switching device in which the tool used in the hammer drill, e.g., a flat or spade-shaped chisel, can be rotated relative to the hammer drill into a desired position.

According to a particular advantageous embodiment of the present invention, the clockwise drive gear means and the counterclockwise gear means include, respectively, a first drive gear and a second drive gear both driven by the drive pinion and both having, respectively, tooth surfaces arranged opposite each other. In this way, an easy switching between clockwise and counterclockwise rotational directions with the control handle can be effected.

Advantageously, both first and second drive gears are permanently engaged with the drive pinion, and are alternatively rotatably connected with the tool spindle by the switching device. Thereby, an easy and disturbance-free switching between clockwise and counterclockwise rotational directions becomes possible.

Advantageously, the switching device has a sleeve-shaped shifting member for rotatably connecting the tool spindle alternatively with one of the first and second drive gears. The shifting member is supported on the tool spindle for joint rotation therewith and for axial displacement relative thereto. Thereby, different positions of the switching device can be precisely and reliably retained.

Advantageously, the switching device has a chiselling position in which a pure chiseling operation takes place in which the tool spindle is operatively connected to the hammer drill housing without a possibility of rotation relative thereto. Thereby, in a simple way, rotation of a chisel tool during a chiseling operation is prevented so that a precise chiseling operation can be carried out.

Advantageously, the shifting member has engagement means engaging matching engagement means fixedly secured to the housing in the chiseling position of the switching device for preventing rotation of the tool spindle relative to the housing. Thereby, a particularly reliable securing of a chisel tool against rotation is achieved.

It is particularly advantageous when the percussion mechanism is operated by an eccentric member driven by a drive member. Between the eccentric member and the drive member, there is provided separable coupling means operated by the switching device. Thereby, an easy actuation and deactivation of the percussion mechanism with the switching device is achieved.

It is advantageous when the coupling means is formed as a coupling member permanently rotatably connected with one of the eccentric member and the drive member and rotatably disconnected from another of the eccentric member and the drive member in a switch-off position. Thereby, a disturbance-free actuation and deactuation of the percussion mechanism becomes possible.

According to a particularly advantageous embodiment of the coupling means, the coupling member has a ramp profile that can be abutted by a movable bearing region of the switching device and which presses the coupling member back in an axial direction upon its rotation. Thereby, in a simple way, a separation movement of the coupling member for decoupling the eccentric member from the drive member is generated.

Advantageously, the bearing region is formed on a shift plate supported in the hammer drill for linear displacement and which is displaceable by the control handle. This likewise insures a disturbance-free actuation and deactuation of the percussion mechanism.

It is particularly advantageous when the shift plate is translationally connected with the sleeve-shaped shifting member of the switching device. Thereby, the shift plate is used for both switching the drive gears and for actuation and deactuation of the percussion mechanism, which noticeably simplifies the construction of the switching device and reduces the manufacturing costs.

Further, the shift plate advantageously has a tooth profile connected, directly or indirectly, with a rotatable matching tool profile provided on the control handle. This insures a particularly precise shifting of the switching device and thereby a reliable switching between the different hammer drill functions.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
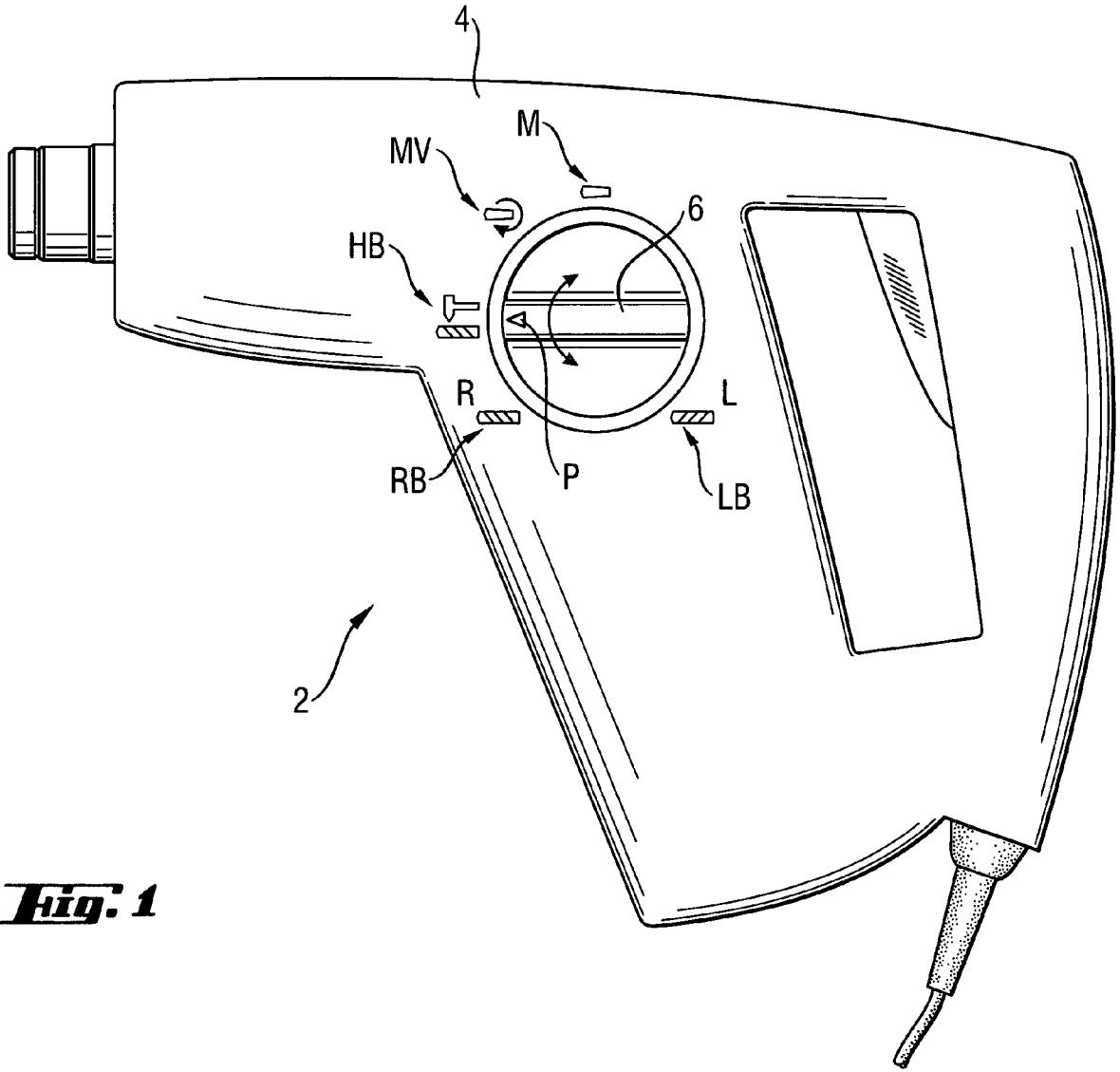
FIG. 1 a side view of a hammer drill according to the present invention.

A hand-held, electrically driven hammer drill 2 according to the present invention, which is shown in FIG. 1, has a housing 4 on which there is provided a control handle 6 in form of a rotary switch for setting up a desired drill function. The control handle 6, together with an arrow symbol P, can be rotated relative to the housing 4, to one of five switching positions which are shown with corresponding symbols on the housing 4. Each switching position corresponds to a different drill function. There are provided chiseling position M, shifting-to-chiseling position MV, rotary-percussion position HB, clockwise drilling position RB, and counterclockwise drilling position LB.

Figure 2:
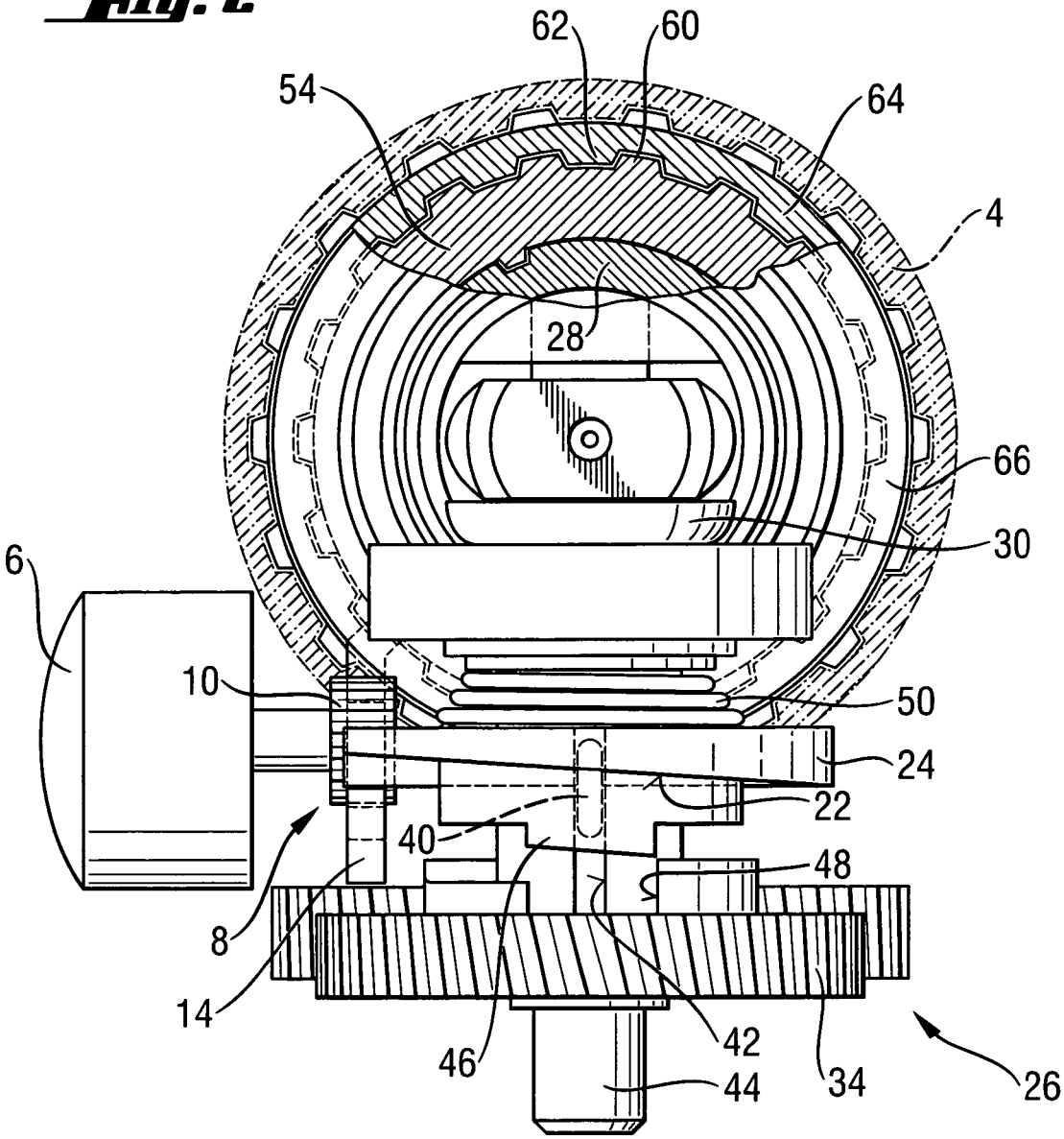
FIG. 2 a side, partially cross-sectional view of the eccentric drive of the hammer drill shown in FIG. 1 in its operational position in a set-up according to FIGS. 8 and 9.
Figure 3:
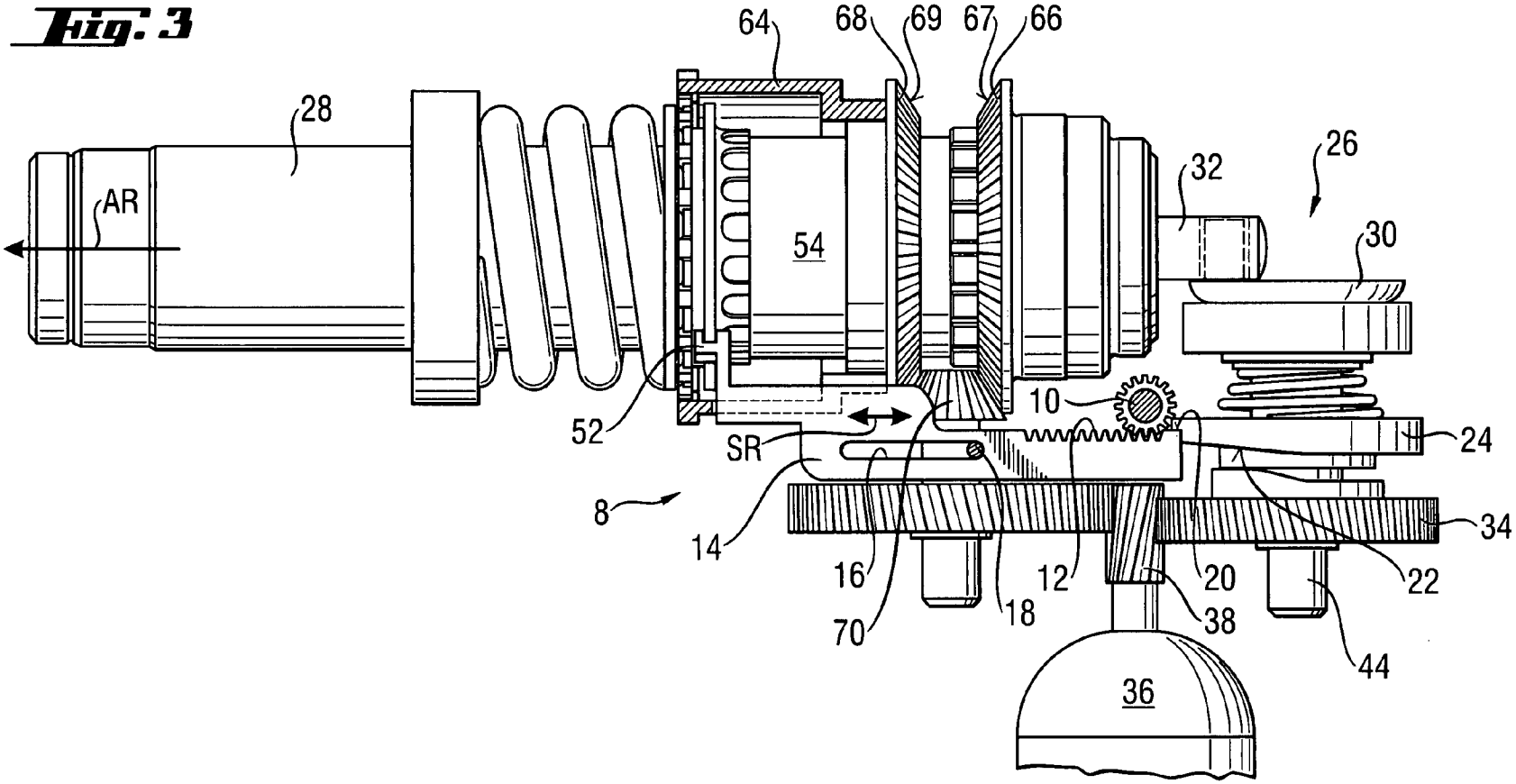
FIG. 3 a side, cross-sectional view of a switching device with the eccentric drive according to FIG. 2 in a set-up according to FIG. 5.

As shown in FIGS. 2 and 3, the control handle 6 is used for actuation for a switching device 8. The switching device 8 has a pinion 10 connected with the control handle 6 for joint rotation therewith and engaging a tooth profile 12 provided on a shift plate 14. The shift plate 14 has an elongate opening 16 through which a guide member 18, which is fixedly secured to the housing extends. In this way, the shift plate 14 is supported for a linear displacement relative to the housing 4 along a displacement path SR.

At its rear, with respect to the operational direction AR of the hammer drill 2, end, the shift plate 14 of the switching device 8 forms a bearing region 20. At a corresponding positioning, the shift plate 14 lies on a ramp profile 22 that is formed on a displaceable coupling member 24 of an eccentric drive 26.

The eccentric drive 26 forms part of a percussion mechanism (not shown in detail) that applies blows to a tool spindle 28 in the operational direction AR upon its reciprocal movement during chiseling and rotary-percussion operations. The eccentric drive 26 includes an eccentric member 30 which, upon its rotation applies a reciprocating movement to a piston rod 32 in the operational direction AR.

The coupling member 24 connects the eccentric member 30 with a drive member 34 for joint rotation therewith. The drive member 34 is permanently engaged with a pinion 38 of a motor 36. As shown in FIG. 2, the coupling member 24 engages, with a rib 40, in a groove 42 that is formed in an axle 44 connected with the eccentric member 30 for joint rotation therewith. The drive member 34 is rotatably supported on the axle 44. The torque transmission from the drive member 34 to the eccentric member 30 takes place only when the coupling member 24 is displaced along the groove 42 into a position in which an engagement member 46 of the coupling member 24 engages the matching engagement element 48 of the drive member 34. The coupling member 24 is preloaded in the engagement position with a spring 50.

As further shown in FIG. 3, the shift plate 14 has, at its front, with respect to the operational direction AR of the hammer drill 2, end, an adjusting region 52 that is translationally connected with a sleeve-shaped shifting member 54 of the switching device 8. E.g., the adjusting region 52 applies a sidewise pressure to the shifting member 54 when, simultaneously, a biasing force is applied to its opposite side. As shown in FIG. 3, the adjusting region 52 is engageable with the shifting member 54 on both side of the operational direction AR. In this way, the shifting member 54 is displaceable on the tool spindle 28 by the adjusting region 52 of the shift plate 14.

Figure 4:
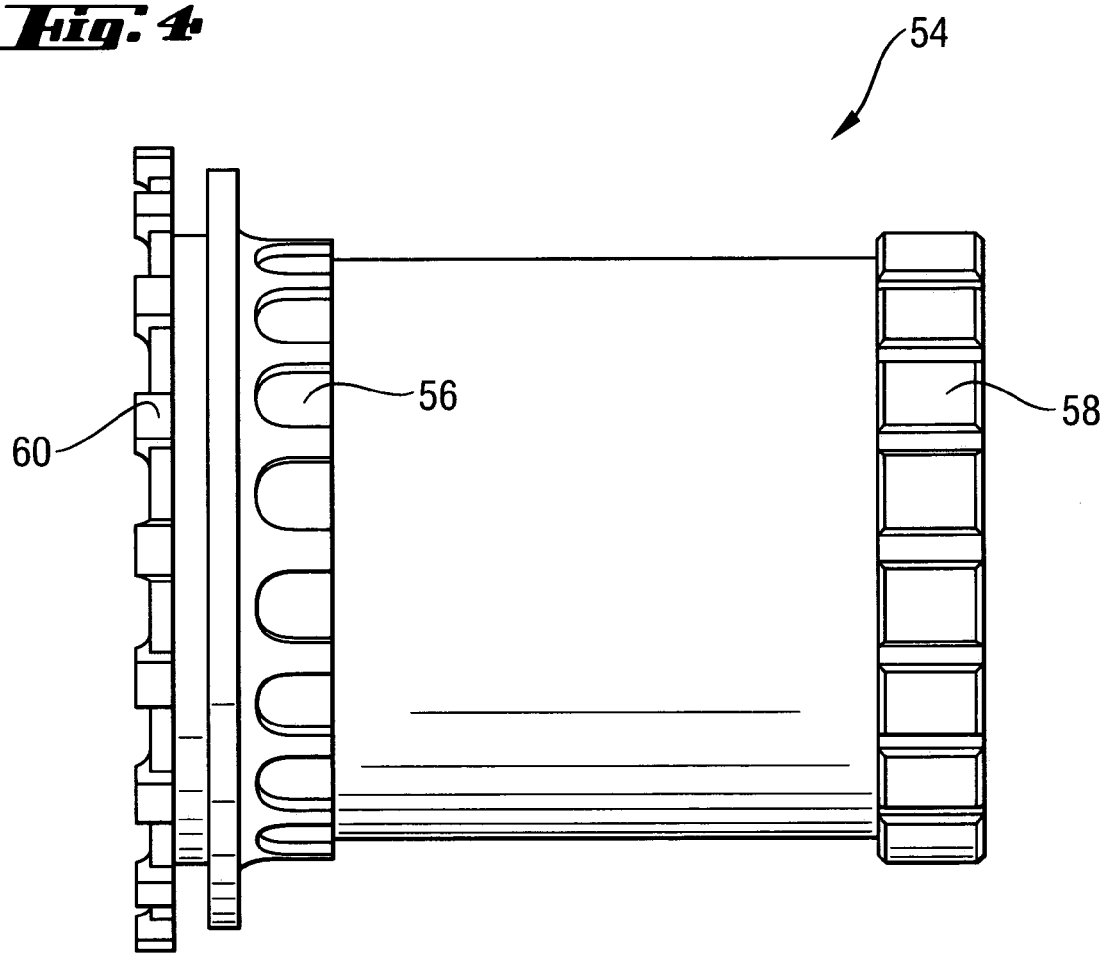
FIG. 4 a side view of the shifting member of the switching device shown in FIG. 3.

The shifting member 54 is shown in detail in FIG. 4. As shown in FIG. 4, there are provided, on the circumferential surface of the shifting member 54, engagement bays 56. There are further provided, on one end surface of the shifting member 54, engagement cams 58 and on the other, opposite end surface thereof, there is provided a crown formed of engagement elements 60.

As shown in FIGS. 2-3, in a respective position of the shifting member 54, the crown with engagement elements 60 can be brought into engagement with matching engagement elements 62 which are formed on an intermediate ring 64 secured to the housing 4. The shifting member 54 is supported on the tool spindle 28 for joint rotation therewith. Thereby, the tool spindle 28 can be secured against rotation by the shifting member 54 when the engagement elements 60 to engage the matching engagement elements 62 that are provided on the intermediate ring 64 which is fixedly secured to the housing 4.

The shifting member 54 also connects the tool spindle 28 with first or second drive gear 66, 68 which are connected by a drive pinion 70 with the motor pinion 38. The first drive gear 66 has a tooth surface 67 that is arranged opposite a tooth surface 69 of the second drive gear 68. The drive pinion 70 extends between the two surfaces 67, 69 and permanently engages the first and second drive gears 66, 68, forming a clockwise drive with the first drive gear 66 and counterclockwise drive with the second drive gear 68.

FIGS. 5-9 show functioning of the switching device 8 in separate shift positions.

Figure 5:
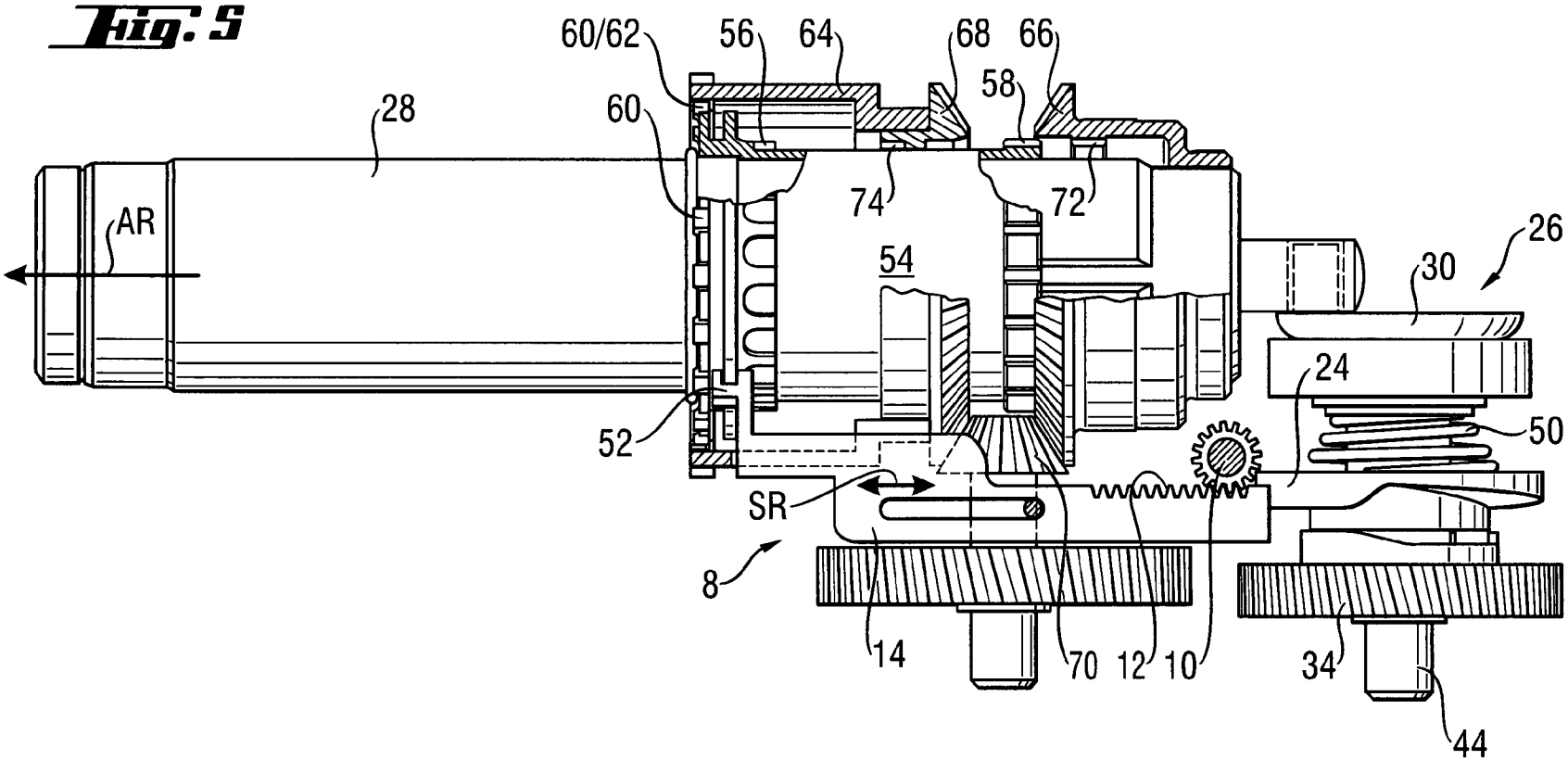
FIG. 5 a side, partially cross-sectional view of the switching device shown in FIG. 3 in a chiseling position.

FIG. 5 shows the switching device in a position corresponding to chiseling operation of the hammer drill 2, which position is also shown in FIG. 3. This position is obtained by switching the control handle 6 into a chiseling position M. The switching of the control handle 6 leads to rotation of the rotation of the pinion 10 which is engaged with a tooth profile 12 of the shift plate 14. As a result of rotation of the pinion 10, the shift plate 14 is displaced in the displacement direction SR until it reaches its outmost position in the operational direction AR. Upon its displacement, the shift plate 14 displaces, with its adjusting region 52, the shifting member 54 in the operational direction AR, resulting in engagement of the elements 60 with the engagement elements 62 of the intermediate ring 64. This results in connection of the tool spindle 28 with the housing 4, so that the tool spindle 28 cannot rotate relative to the housing 4. In this position of the spindle 28, the drive gears 66, 68 are rotationally decoupled from the shifting member 54, and no rotational coupling exists between the drive pinion 70 and the tool spindle 28 with which a torque can be transmitted to the tool spindle 28.

Simultaneously, the displaceable coupling member 24 of the eccentric drive 26 is biased by the spring 50 into engagement with the drive member 34 in this position of switching device 8. With the motor 36 being turned on, a torque is transmitted to the eccentric member 30 via the motor pinion 38, drive member 34, coupling member 24, and the axle 44, and the eccentric member 30 actuates the percussion mechanism that is (not shown).

In this position, the hammer drill 2 has a pure chiseling function at which the tool spindle 28 performs only the percussion movement in the operational direction AR, without being rotated.

Figure 6:
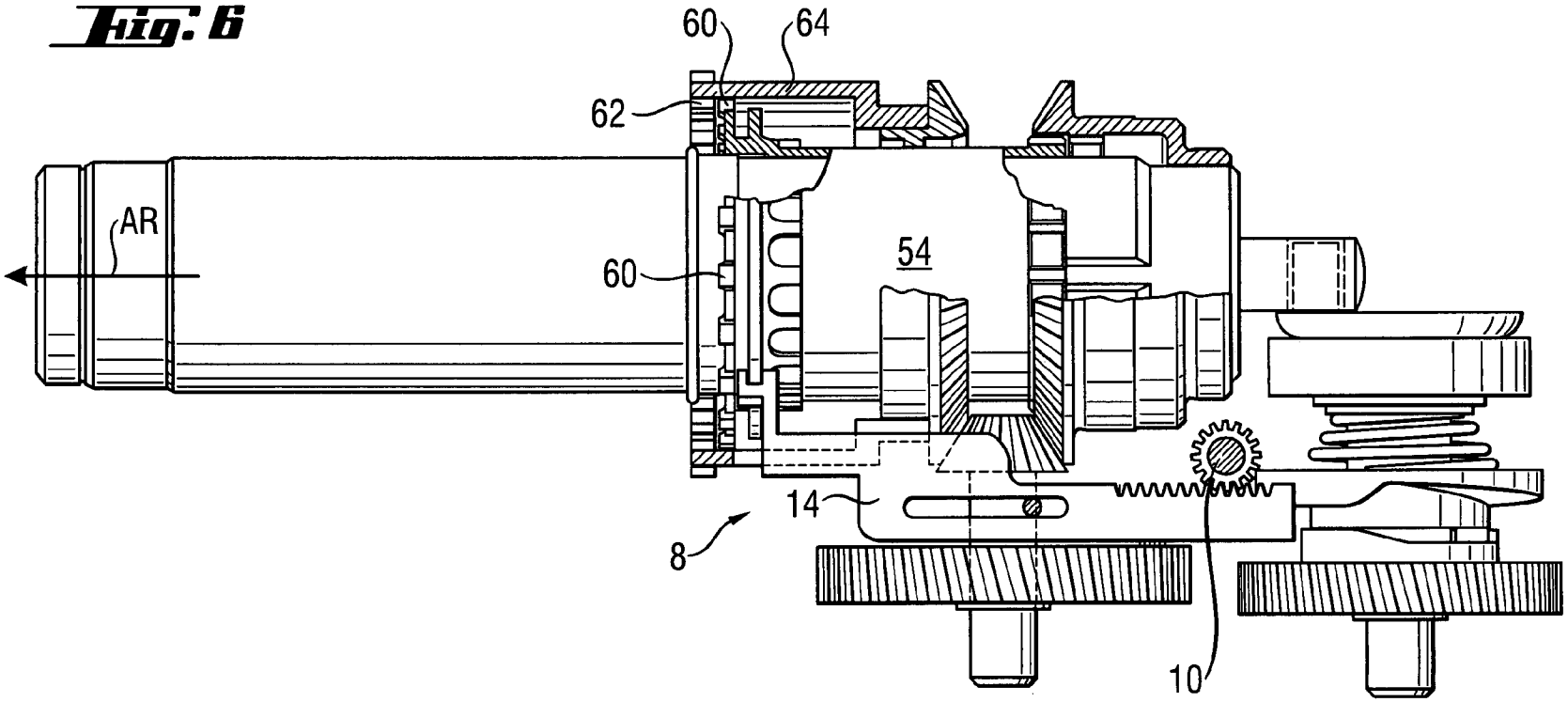
FIG. 6. a side, partially cross-sectional view of the switching device shown in FIG. 3 in a position during shifting to the chiseling position.

Upon rotation of the control handle 6 into the shifting-to-chiseling position MV, the switching device 8 assumes a position shown in FIG. 6. In this position of the switching device 8, the shift plate 14 is displaced by the pinion 10 in a direction opposite the operational direction AR. Simultaneously, the shifting member 54 becomes disengaged from the intermediate ring 64. In this position, the shifting member 54 is rotationally decoupled from the drive gears 66, 68, and no torque is transmitted to the tool spindle 28.

In this position, the hammer drill 2 has a shifting-to-chiseling function at which a chisel (not shown) is inserted into the tool spindle 28 that can be pivoted to any arbitrary position. Thereby, e.g., a flat or spade-shaped chisel can be so aligned with respect to the hammer drill 2 that the hammer drill 2 is conveniently held during operation.

Figure 7:
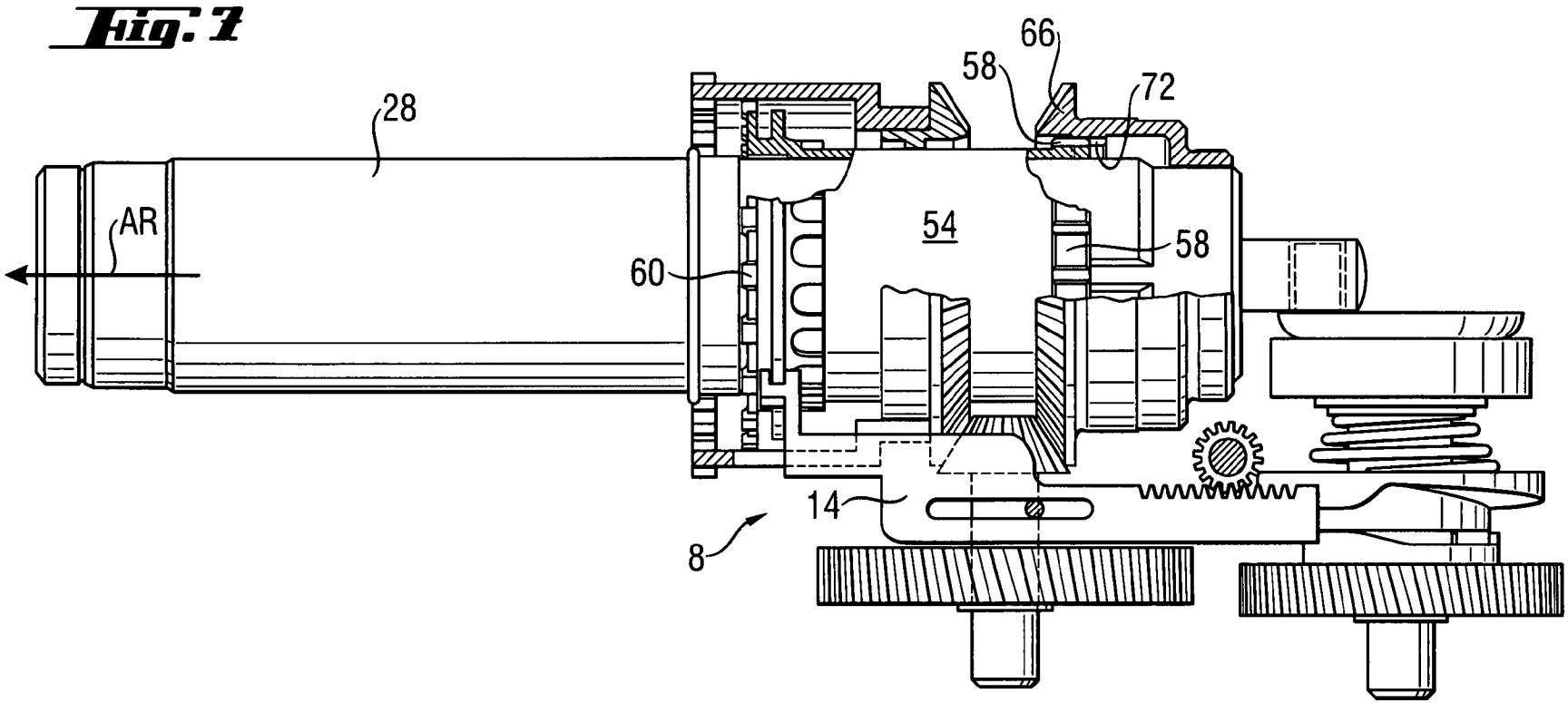
FIG. 7. a side, partially cross-sectional view of the shift in device according to FIG. 3 in a position for effecting a drilling and percussion operational.

Upon rotation of the control handle 6 to the rotary-percussion position, the switching device 8 occupies a position shown in FIG. 7. In this position of the switching device 8, the shift plate 14 is displaced even further in the direction opposite the operational direction AR, and the shifting member 54 is displaced so far that the engagement cams 58 engage the matching engagement profile 72 of the first drive gear 66. In this way, a clockwise rotational connection is formed between the motor pinion 38 and the tool spindle 28 via the drive pinion 70, the first drive gear 66, and the shifting member 54, which insures a clockwise rotational movement of the tool spindle 28. Simultaneously, the motor 36 also drives the percussion mechanism.

In this position, the hammer drill 2 performs both drilling and percussion functions, so that both clockwise rotation and percussion movement in the operational direction AR are imparted to the tool spindle 28.

Figure 8:
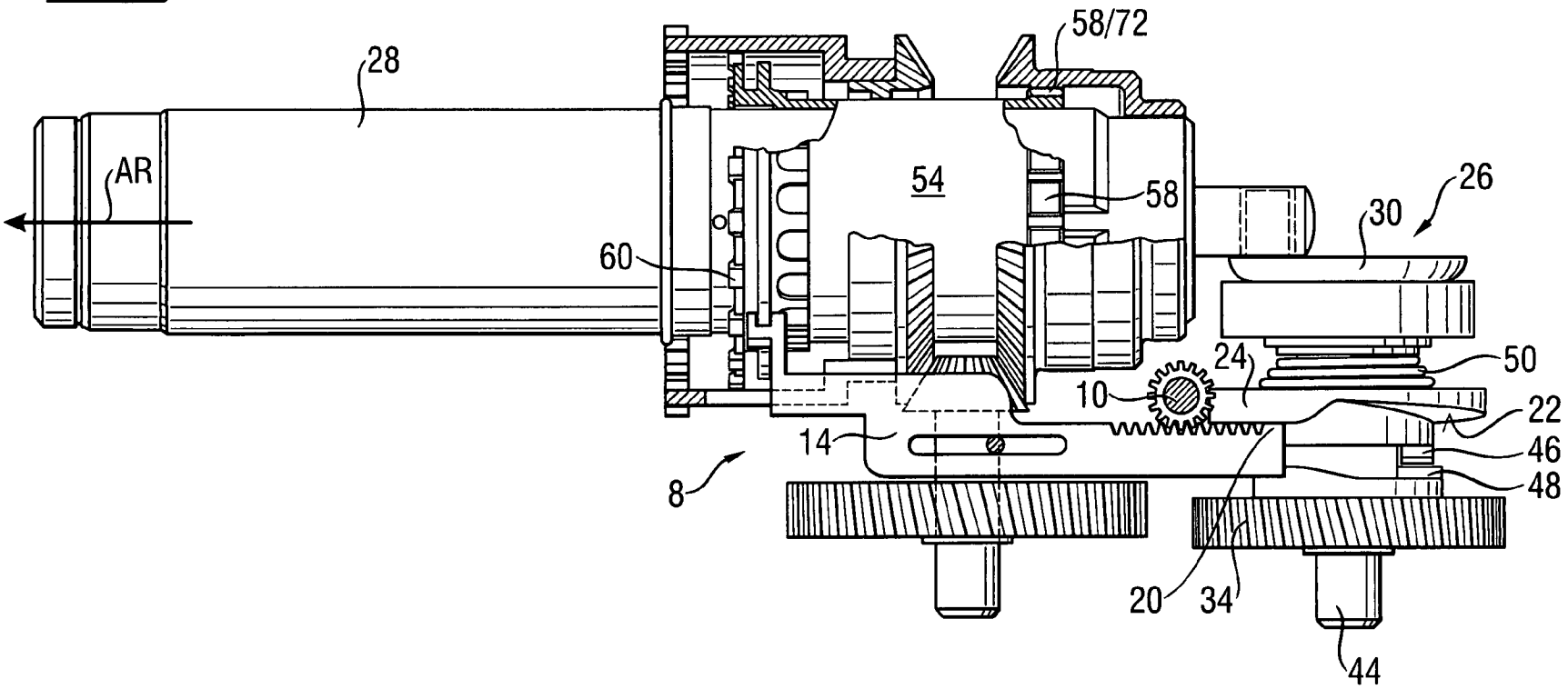
FIG. 8. a side, partially cross-sectional view of the switching device shown in FIG. 3 in a clockwise drilling position.

Upon rotation of the control handle 6 to the clockwise drilling position RB, the switching device 8 occupies a position shown in FIG. 8. In this position of the switching device 8, the clockwise rotational connection of the tool spindle 28 with the motor pinion 38 is retained, but the shift plate 14 is displaced so far in the direction opposite the operational direction AR that its bearing region 20 abuts the ramp profile 22. During the rotation of the eccentric drive 26, the coupling member 24 applies pressure to the bearing region 20 only through the ramp profile 22 and is displaced out of the engagement with the drive member 34 against the biasing force of the spring 50. In this way, the eccentric member 30 becomes rotationally disengaged from the drive member 34, and the percussion mechanism is deactivated.

In this position of the switching device 8, the hammer drill 2 has a clockwise drilling function at which the tool spindle 28 performs a simple clockwise rotation.

Figure 9:
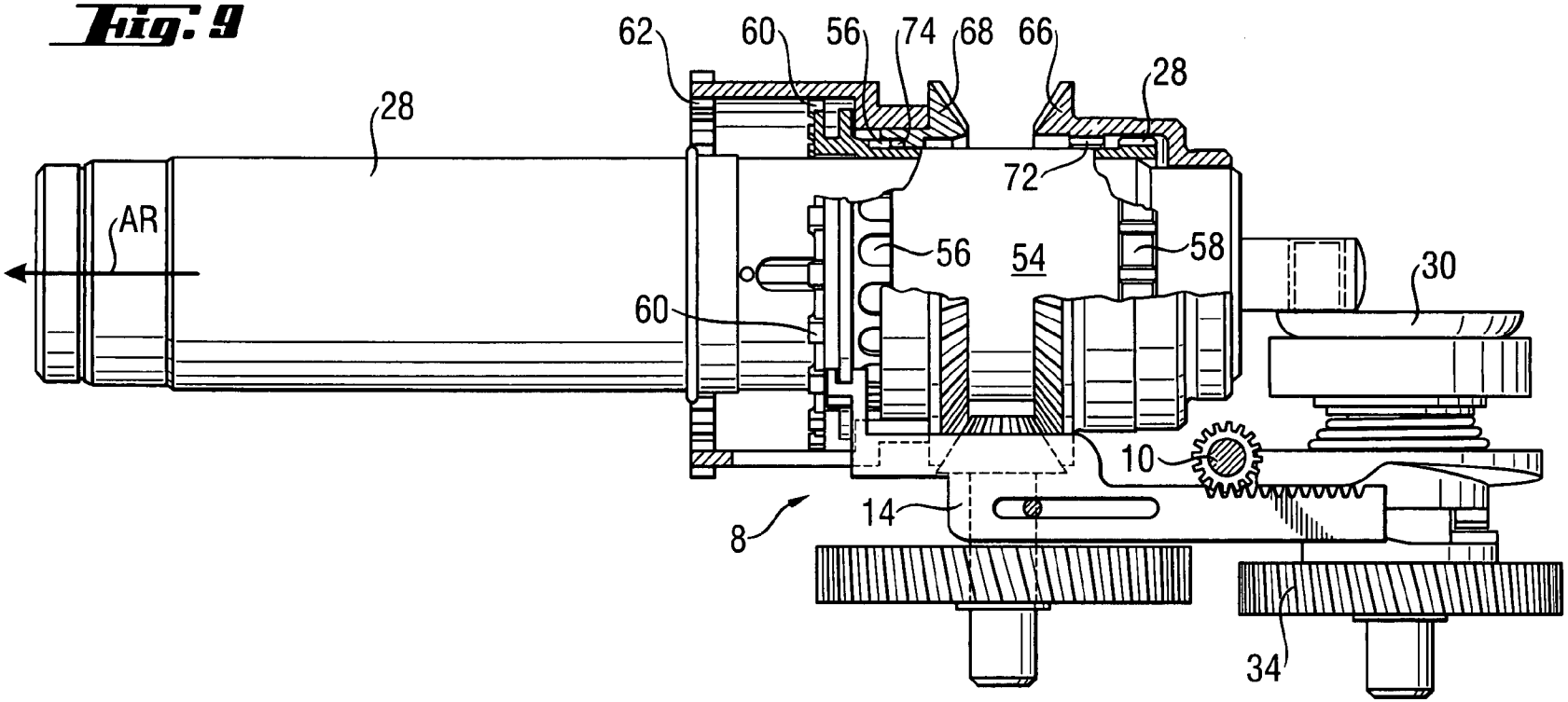
FIG. 9 a side, partially cross-sectional view of the switching device shown in FIG. 3 in a counterclockwise drilling position.

Upon rotation of the control handle 6 to the counterclockwise rotation position LB, the switching device 8 occupies a position shown in FIG. 9. In this position of the switching device 8, the eccentric member 30 remains rotationally decoupled from the drive member 34. The shifting member 54 is in its outmost position in the direction opposite the operational directional AR. In this position of the shifting member 54, the engagement cams 58 are disengaged from the matching engagement profile 72 of the first drive gear 66, and only the engagement bays 56 form an engagement connection with the matching engagement profile 74 of the second drive gear 68. Thereby, only a counterclockwise rotational connection is formed between the motor pinion 38 and the tool spindle 28 via the drive pinion 70, the second drive gear 68, and the shifting member 54, which results in the counterclockwise rotation of the tool spindle 28.

In this position of the switching device 8, the hammer drill 2 has a counterclockwise drilling function at which the tool spindle simply performs a counterclockwise rotational movement.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hammer drill (2) for carrying out a pure drilling operation, a pure percussion operation, and a rotary-percussion operation, comprising:

a clockwise and counterclockwise driven tool spindle (28);

a drive pinion (70) operationally connectable with the tool spindle (28) for transmitting a torque thereto;

a separate control handle (6) rotatable to different positions for selecting one of the pure drilling operation, the pure percussion operation, and the rotary-percussion operation;

a switching device (8) adjustable in accordance with a position of the control handle (6) and shiftable by the control handle (6) in a clockwise rotation position for effecting a pure drilling operational in a clockwise direction and in a counterclockwise rotation position for effecting a pure drilling operation in a counterclockwise direction; and an eccentric member (30) for driving a percussion mechanism or the hammer drill (2), and a drive member (34) for driving the eccentric member (30), wherein the switching device (8) comprises coupling means (24) arranged between the eccentric member (30) and the drive member (34).

2. A hammer drill according to claim 1, wherein the switching device (8) includes clockwise drive gear means and counterclockwise drive gear means for alternatively forming a clockwise rotational connection and a counterclockwise rotational connection between the tool spindle (28) and the drive pinion (70) in a pure drilling operation.

3. A hammer drill according to claim 2, wherein the switching device (8) is switchable by the control handle (6) in an additional position in which the clockwise and counterclockwise drive gear means occupies a position in which both the clockwise rotational connection and the counterclockwise rotational connection between the drive pinion (70) and the tool spindle (28) are broken, and the tool spindle (28) is rotatable relative to a hammer drill housing (4).

4. A hammer drill according to claim 2, wherein the clockwise drive gear means and the counterclockwise gear means comprises, respectively, a first drive gear (66) connectable with the tool spindle (28) for providing the clockwise drilling operation, and a second drive gear (68) connectable with the tool spindle (28) for providing the counterclockwise drilling operation, the first and second drive gears (66, 68) having respective tooth surfaces (67, 69) arranged opposite each other.

5. A hammer drill according to claim 4, wherein both the first and second drive gears (66, 68) are permanently connected with the drive pinion (70) and are alternatively rotatably connectable with the tool spindle (28).

6. A hammer drill according to claim 5, wherein the switching device (8) comprises a sleeve-shaped shifting member (54), for rotatably connecting the tool spindle (28) alternatively with one of the first and second drive gears (66,68) and supported on the tool spindle (28) for joint rotation therewith and for axial displacement relative thereto.

7. A hammer drill according to claim 1, wherein the switching device (8) has a chiseling position in which a pure chiseling operation takes place and in which the tool spindle (28) is operatively connected to a hammer drill housing (4) without a possibility of rotation relative thereto.

8. A hammer drill according to claim 7, wherein the switching device (8) comprises a shifting member (54) having engagement means (60) engaging matching engagement means (62) fixedly secured to the housing (4) in the chiseling position of the switching device (8) for preventing rotation of the tool spindle (28) relative to the housing (4).

9. A hammer drill according to claim 1, wherein the coupling means comprises a coupling member (24) permanently rotatably connected with one of the eccentric member (30) and the drive member (34) and rotatably disconnected from another of the eccentric member (30) and the drive member (34) in a switch-off position.

10. A hammer drill according to claim 9, wherein the coupling member (24) has a ramp profile (22); and the switching device (8) has a movable bearing region (20) engaging the ramp profile (22) for displacing the coupling member (24) in an axial direction away from the another of the eccentric member (30) and the drive member (34) upon rotation thereof.

11. A hammer drill according to claim 10, wherein the switching device (8) comprises a shift plate (14) linearly displaceable in the hammer drill (2) and adjustable by the control handle (6), and wherein the bearing region (20) is provided on the shift plate (14).

12. A hammer drill according to claim 11, wherein the switching device (8) comprises a sleeve-shaped shifting member (54) translationally connectable with the shift plate (14).

13. A hammer drill according to claim 11, wherein the shift plate (14) has a tooth profile (12) connected, directly or indirectly, with a rotatable matching tooth profile provided on the control handle (6).

* * * * *